US008322791B2

(12) United States Patent
Port

(10) Patent No.: US 8,322,791 B2
(45) Date of Patent: Dec. 4, 2012

(54) FOOTREST

(76) Inventor: Nathan Jay Port, Anketell (AU)

( * ) Notice: Subject to any disclaimer, the term of this patent is extended or adjusted under 35 U.S.C. 154(b) by 216 days.

(21) Appl. No.: 12/622,499

(22) Filed: Nov. 20, 2009

(65) Prior Publication Data

US 2010/0133890 A1 Jun. 3, 2010

(30) Foreign Application Priority Data

Nov. 28, 2008 (AU) ..... 2008906192

(51) Int. Cl.
*A47C 16/00* (2006.01)

(52) U.S. Cl. ..... 297/423.39; 297/423.4; 297/423.46

(58) Field of Classification Search ..... 297/423.39, 297/423.41, 423.42, 423.44, 423.46, 423.4
See application file for complete search history.

(56) References Cited

U.S. PATENT DOCUMENTS 2,528,331 A * 10/1950 Bell ..... 297/423.46
4,441,758 A * 4/1984 Fleischer et al. ..... 297/423.46
5,116,100 A * 5/1992 Iversen ..... 297/313
5,316,370 A * 5/1994 Newman ..... 297/313
5,577,806 A * 11/1996 Ugalde ..... 297/423.46
5,898,953 A * 5/1999 Paxon ..... 4/248
6,702,383 B2 * 3/2004 Newman et al. ..... 297/313

* cited by examiner

*Primary Examiner* — Sarah B McPartlin
(74) *Attorney, Agent, or Firm* — Edell, Shapiro & Finnan, LLC

(57) ABSTRACT

A footrest for supporting the feet of a user above a floor is disclosed. The footrest comprises a platform having an upper surface for accommodating the feet of the user and a pair of planar portions extending downwardly from said generally flat portion. The platform is coupled to at least one support arm for supporting a portion of the platform in an elevated position relative to the floor. The at least one support arm having a first end dynamically coupled to a fulcrum whereby the support arm is biased towards a first position and moveable towards a second position responsive to a force being applied in use to the upper surface of the platform by the feet of the user.

17 Claims, 6 Drawing Sheets

FOOTREST

FIELD

The present invention relates to a dynamic footrest.

BACKGROUND

Most persons who work at desks or tables are presented with such desks and tables at a pre-determined height. Such persons will typically have a height-adjustable chair which may be used to bring their upper body into a proper relationship with the desk. Several ergonomic office chair manufacturers now incorporate mechanisms that allow the seat pan and backrest to self adjust and follow the motions of the user. Such adjustments, however, do not take into account the distance between the feet of the person and the floor. It is thus reasonably common for a person to use a footrest to bring the user's legs into an ergonomically correct position so as to avoid problems such as leg strain, back strain, and circulatory problems.

Footrests are often provided for airline or coach passengers to improve comfort. In recent times there has been increasing concern about alleviating the potential to develop deep vein thrombosis (DVT) in airline or coach passengers who are required to sit for lengthy time periods. Such passengers are known to move about the cabin of an airplane to improve circulation, leaving the confines and safety of their seat, with the additional risk of being injured in the event of unexpected movement of the aircraft in flight. Prior art footrests, whilst height-adjustable, remain fixed in a position in use.

There remains a need for an improved ergonomic footrest which allows dynamic adjustment to be accomplished during use.

SUMMARY

According to a first aspect of the present invention there is provided a footrest for supporting the feet of a user above a floor comprising:

- a platform having an upper surface for accommodating the feet of the user and a pair of planar portions extending downwardly from said generally flat portion;
- the platform coupled to at least one support arm for supporting a portion of the platform in an elevated position relative to the floor; and,
- the at least one support arm having a first end dynamically coupled to a fulcrum whereby the support arm is biased towards a first position and moveable towards a second position responsive to a force being applied in use to the upper surface of the platform by the feet of the user.

In one form the footrest further comprises a biasing means provided at the fulcrum for biasing the at least one support arm towards the first position, whilst allowing movement of the at least one support arm towards the second position responsive to a force being applied, in use, to the upper surface of the platform by the feet of the user. The biasing means may be a torsion element.

In one form the height of the first position of the platform above the floor can be set when the footrest is not in use using an adjustment means provided in the at least one support arm. The adjustment means may be a clamp that, when locked in use, fixes the position of the casing relative to the hub, and wherein the adjustment means is unlockable to allow the angle of the support arms relative to the floor to be increased or decreased to vary the height of the first position of the platform.

Advantageously, the platform may be rotatably coupled to the at least one support arm so that the angle formed between a leading edge of the platform relative to the floor varies upon application of a titling force on the platform by the feet of the user. In one form the platform may be rotatably mounted on the at least one support arm via a connecting member extending at right angles from the at least one support arm.

In one form the at least one support arm is a first support arm disposed adjacent to one of the planar portions of the platform and the footrest further comprises a second support arm disposed adjacent to the other of the pair of planar portions on the other side of the platform. The connecting member may extend at right angles from the first support arm, and connect the first support arm with the second support arm to hold the position of the first and second support arms fixed relative to each other.

In one form the platform has a flat surface and a convex surface and the platform is oriented such that the convex surface is the upper surface. Conveniently, the platform may be movable from one orientation in which the flat surface is the upper surface to another orientation in which the convex surface is the upper surface by rotation about the connecting member.

In one form the first end of each of the first and second support arms may be dynamically coupled to a cross member, and the cross member is the fulcrum.

In one form each of the distal ends of the cross member may terminate in a generally square shaped centrally located hub about which one or more elastomeric bearing elements is disposed. The one or more elastomeric bearing elements may be housed within a casing to restrict the movement of the elastomeric bearing elements relative to the hub. Advantageously, the elastomeric elements may allow movement of the casing over the range of plus or minus 30 degrees relative to the hub.

In one form, the footrest may be mounted onto or integrally formed as an accessory to an existing structure or chair by fixing the fulcrum or cross member to a static element of the existing structure or chair.

When a freestanding footrest is desired, the footrest may further comprise a base for supporting the footrest on the floor. The base may comprise first and second base members disposed at the distal ends of the cross member and fixedly connected thereto via the hubs arranged at each of the distal ends of the cross member. In one form the base members, when viewed in side elevation, may be crescent-shaped flat members which are oriented vertically when the base is positioned on the floor in use such that each base member comes into contact with the support surface at only two contact points.

According to a second aspect of the present invention there is provided a footrest substantially as herein described with reference to and an illustrated in the accompanying drawings.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

DETAILED DESCRIPTION

Figure 1:
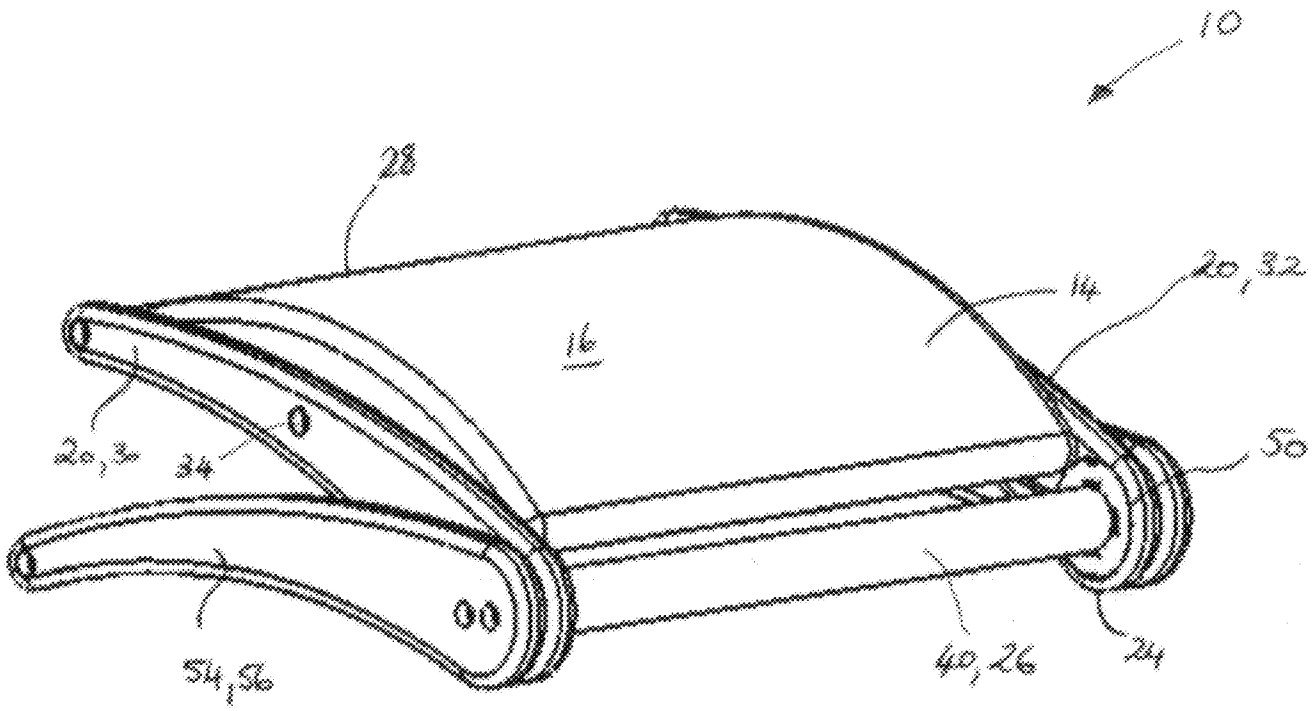
FIG. 1 is an isometric illustration of a freestanding embodiment of the present invention using first and second support arms.

Particular embodiments of the dynamic footrest of the present invention are now described, with particular reference a freestanding footrest that rests, in use, on the floor. The present invention is equally applicable to a footrest that is mounted onto another structure, for example, a footrest that is incorporated as part of a chair which obviates the need for the footrest to include a base. Unless defined otherwise, all technical and scientific terms used herein have the same meanings as commonly understood by one of ordinary skill in the art to which this invention belongs. In the drawings, it should be understood that like reference numbers refer to like members.

Throughout this specification the term "floor" refers to a generally flat open area on which a person can walk or a generally flat open space for an activity. The "dynamically coupled" refers to a coupling which allows free movement as opposed to something which has a fixed or static position.

Figure 2:
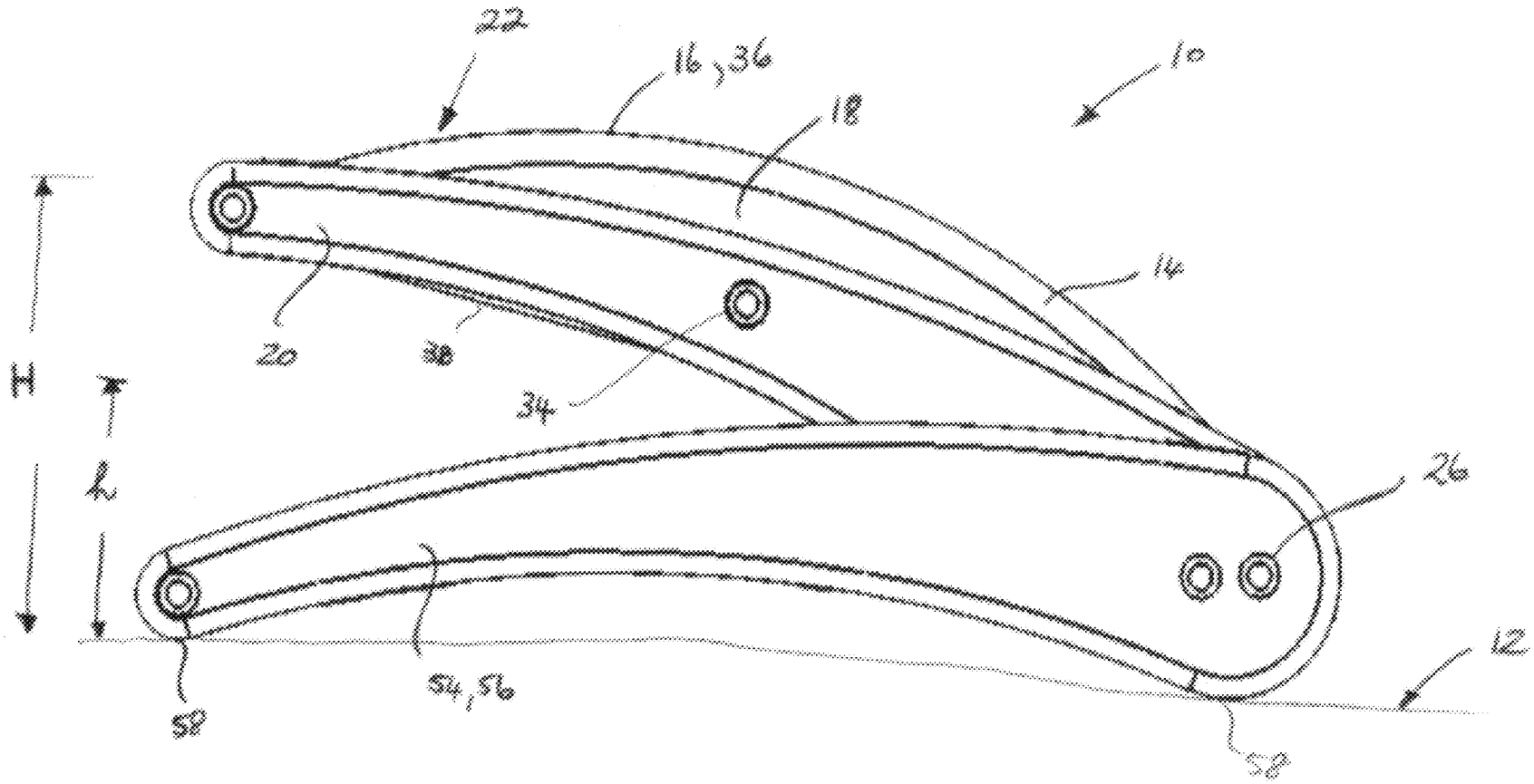
FIG. 2 is a side elevation view of the embodiment illustrated in FIG. 1.

A first embodiment of the footrest of the present invention is illustrated schematically in FIGS. 1 and 2. The footrest (10) is used to support the feet of a user above a generally planar floor (12). The footrest (10) has a platform (14) having an upper surface (16) for accommodating the feet of the user. The platform (14) has a pair of planar portions (18) extending downwardly from said upper surface (16). The platform (14) is coupled to at least one support arm (20) for supporting at least a portion (22) of the platform (14) in an elevated position relative to the floor (12). The at least one support arm (20) has a first end (24) dynamically coupled to a fulcrum (26) whereby the support arm (20) is biased towards a first position and moveable towards a second position responsive to a force being applied in use to the upper surface of the platform by the feet of the user. The first position is displaced at a greater distance to the floor than the second position. By way of example, the height of the first position is labeled as "H" in FIG. 2, with the height of the second position relative to the floor being labeled as "h". As the at least one support arm moves in response to the varying level of force being applied to the platform by the feet of the user, the height of the platform relative to the floor varies accordingly in a dynamic manner.

In the illustrated embodiments, the platform (14) is rotatably coupled to the at least one support arm (20) to allow the platform to pivot in such a way that the angle formed between a leading edge (28) of the platform (14) relative to the floor (12) to be varied upon application of a titling force on the platform (14) by the feet of the user. It is to be understood that the position of the platform relative to the at least one support arm could be fixed, but it is considered preferable to allow the platform to freely tilt in use as this encourages the user to dynamically alter the angle between the feet and the shins. Such movement improves circulation to the extremities by encouraging movement and reducing the application of constant pressure on any given part of the body which occurs using prior art static devices.

In the illustrated embodiments, the at least one support arm (20) is a first support arm (30) disposed adjacent to one of the planar portions (18) of the platform (14). A second support arm (32) is disposed adjacent to the other of the pair of planar portions on the other side of the platform (14). A connecting member (34) extends from the first support arm (30) to the second support arm (32), the connecting member (34) having the secondary function of holding the position of the first and second support arms fixed relative to each other. The platform (14) is rotatably coupled to the connecting member and able to freely pivot thereabout. In the illustrated embodiments, the connecting member (34) is a simple rod or hollow tube having a circular cross-section. The connecting member (34) is positioned at midway along the length of the planar portions (18) for maximum ease of tiltability. The distal ends of the connecting member (34) are mechanically fastened to the first and second support arms (30 and 32, respectively) using any suitable mechanical fastening means, for example, a simple threaded screw. When the footrest (10) is provided with only one support arm (20), the platform (14) can be pivotally mounted on the at least one support arm (20) using a connecting means (34) extending at right angles from the at least one support arm (20).

Figure 3:
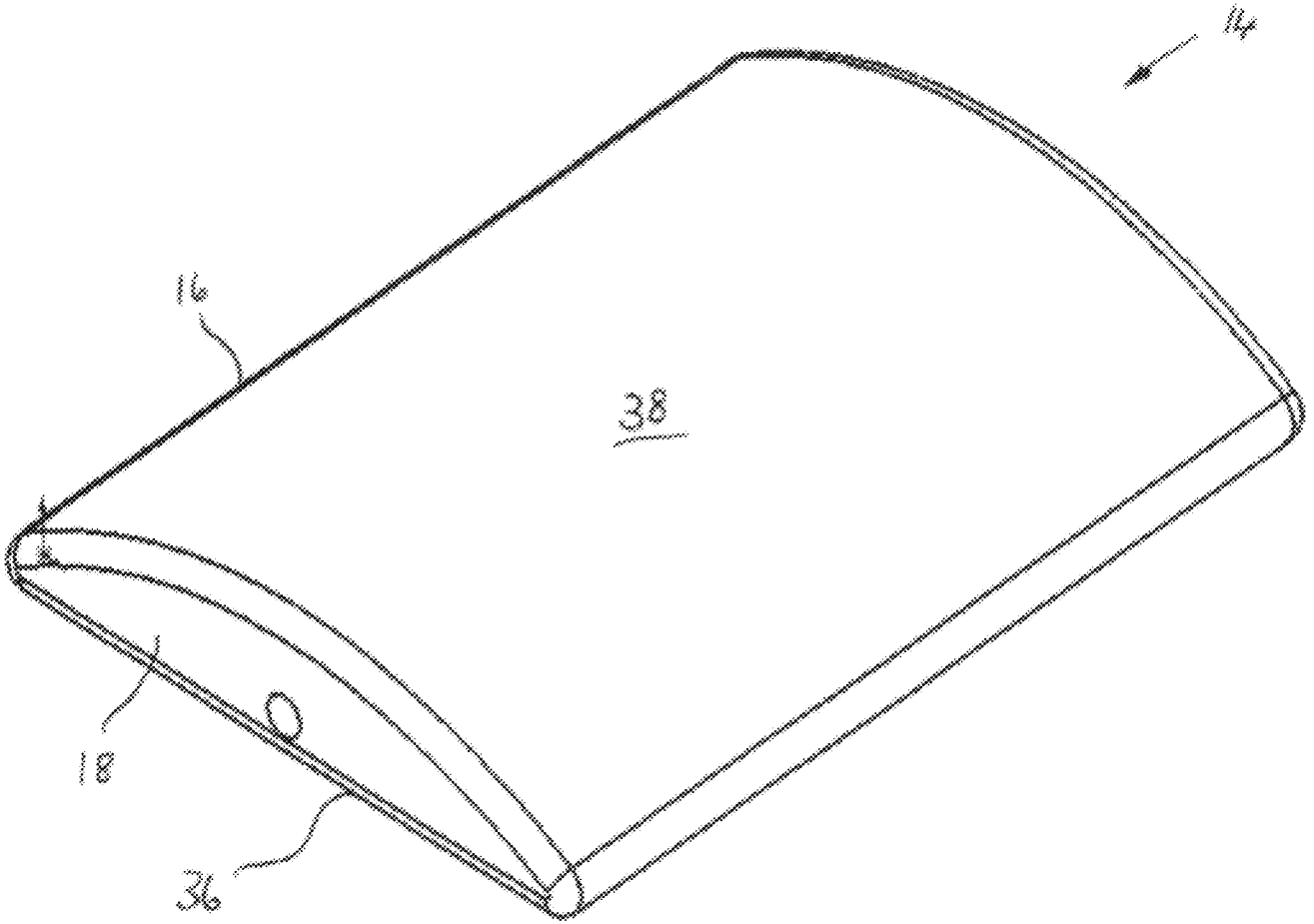
FIG. 3 illustrates one embodiment of the platform having a flat side and a convex side capable of being used in either orientation.
Figure 4:
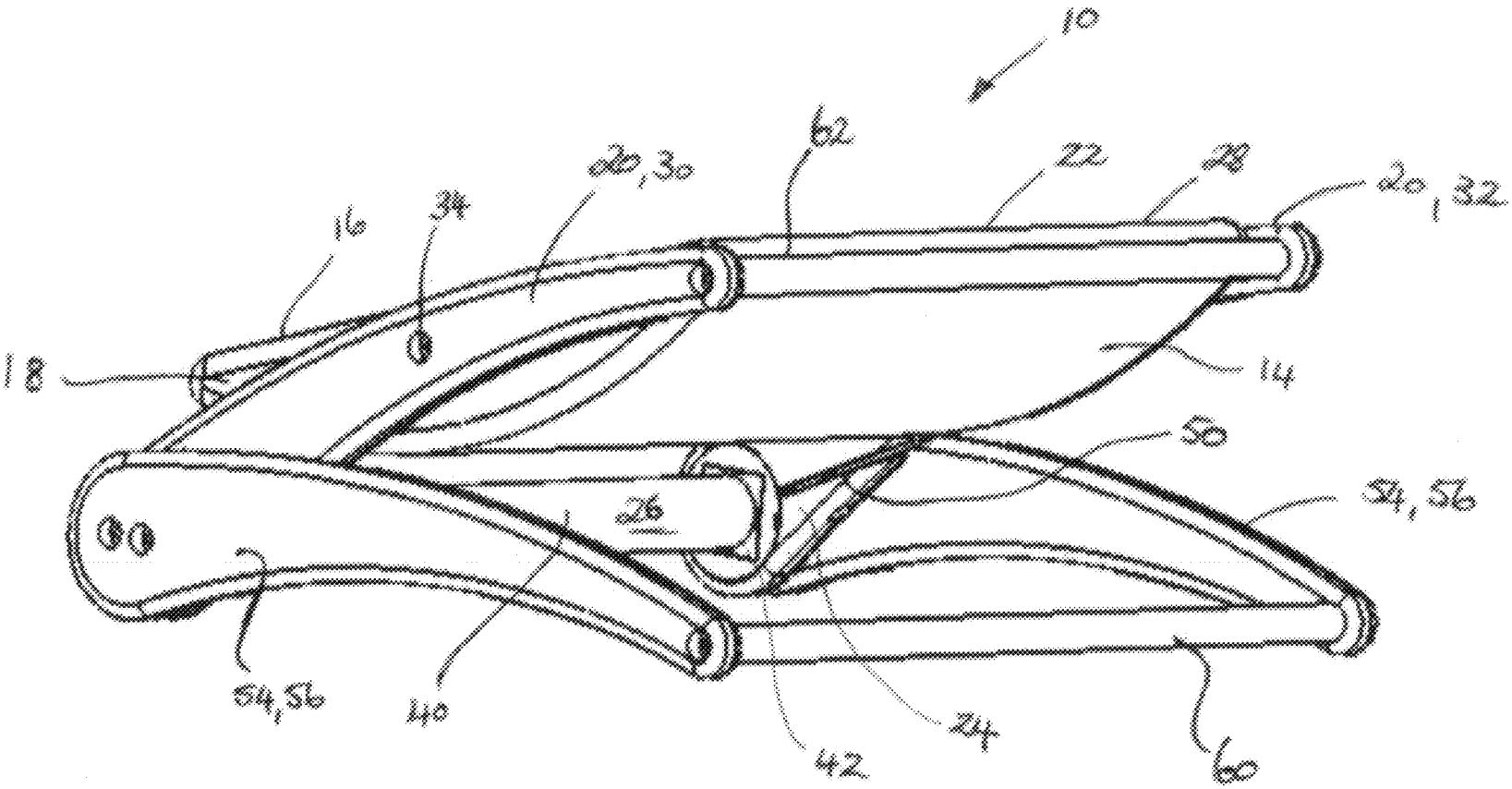
FIG. 4 is an isometric view of the footrest in which the platform is oriented such that the upper surface is the flat surface.
Figure 5:
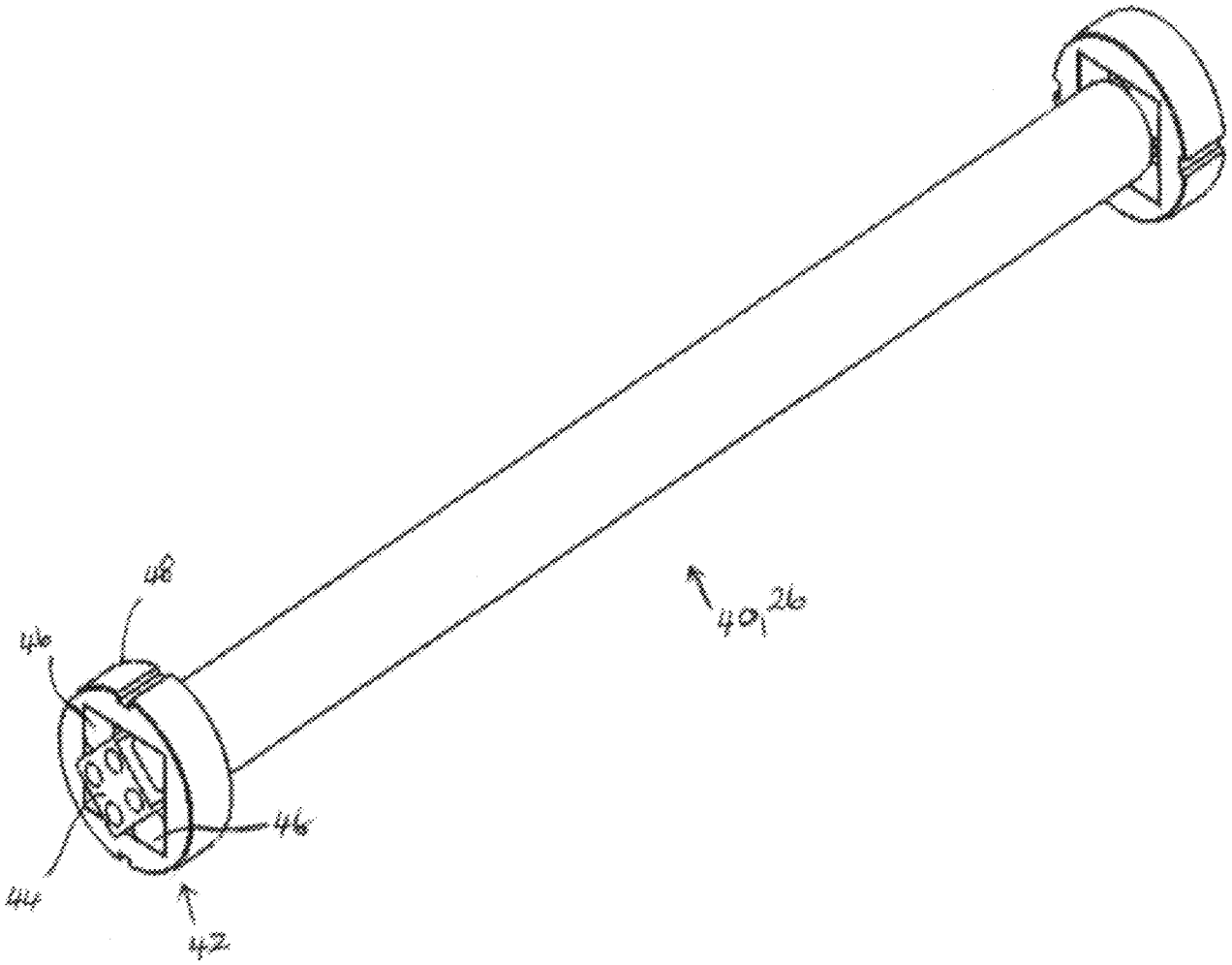
FIG. 5 is an isometric view of one embodiment of the fulcrum.

For comfort, the upper surface (16) of the platform (14) is carpeted but it could equally be covered with a moulded rubber surface. To further encourage circulation in use, the upper surface of the platform may be provided with a plurality of protrusions in the form of ribs or nodes for applying pressure to a plurality of points on the soles of the feet of the user. In the embodiment illustrated in FIG. 3, the platform (14) has a flat surface (36) and a convex surface (38). The platform can thus be disposed in one of two orientations. When the user intends to use the footrest whilst wearing shoes, the platform is oriented such that the flat surface is the upper surface as illustrated in FIG. 4. If the user prefers to use the footrest without wearing shoes, the platform is oriented such that the convex surface is the upper surface as illustrated in FIGS. 1 and 2. The platform (14) can be moved from one orientation to the other by rotation about the connecting member (34).

In the illustrated embodiments, the first end (24) of each of the first and second support arms (30 and 32, respectively) is dynamically coupled to a cross member (40) which serves as the fulcrum. A biasing means (42) is provided towards each of the distal ends of the cross member (40). The biasing means (42) is used to bias each of the first and second support arms (30 and 32, respectively) towards the first position, whilst still allowing movement of the first and second support arms towards the second position responsive to a force being applied, in use, to the upper surface (16) of the platform (14) by the feet of the user.

Where a single support arm is use, the footrest is provided with a single biasing means. It is to be understood that even when the footrest is provided with first and second support arms, there is no requirement for more than one biasing means to be used. For best results in terms of the feel of the product in use, it is preferable for biasing means to be provided for each of the first and second support arms.

The biasing means can take a number of forms. In the embodiment illustrated in FIG. 4, the biasing means (42) are provided in the form of a torsion element. Each of the distal ends of the cross member (40) terminates in a generally square shaped centrally located hub (44) about which one or more elastomeric bearing elements (46) is disposed. The elastomeric bearing elements (46) are housed in turn within a casing (48) which is used to restrict the movement of the elastomeric bearing elements (46) relative to the hub (44). For best results, the elastomeric elements have high rebound resilience, low permanent deformation, high notch toughness and good natural damping. Examples of suitable elastomeric materials include natural rubber and pure synthetic elastomers. The casing (48) is fixedly clamped inside a correspondingly shaped and sized aperture (50) provided at the first end (24) of each of the first and second support arms (30 and 32, respectively). In this way, force applied to the platform by the foot of the user is transmitted via the support arms through the clamped casing to the elastomeric elements. In use, the elastomeric elements (46) allow movement of the casing (48) over the range of plus or minus 30 degrees relative to the hub (44). Spring energy stored in the elastomeric elements changes dynamically in response to changes in the force being applied to the platform by the user, returning support arms to the first position when the footrest is not in use or when the user stops applying force to the platform.

The height of the first position of the platform above the floor can be set when the footrest is not in use using an adjustment means (50) provided in each support arm. An embodiment of the adjustment means (50) used to set the height of the first position of the platform (14) relative to the ground (12) is illustrated in FIG. 4. In this embodiment, the adjustment means (50) is a clamp that, when locked in use, fixes the position of the casing (48) relative to the hub (44). The adjustment means (50) can be unlocked to allow angle of the support arms (20) relative to the floor (12) to be increased or decreased. This in turn allows the height of the first position of the platform to be adjusted and then set when the adjustment means (50) in locked prior to use.

Figure 6:
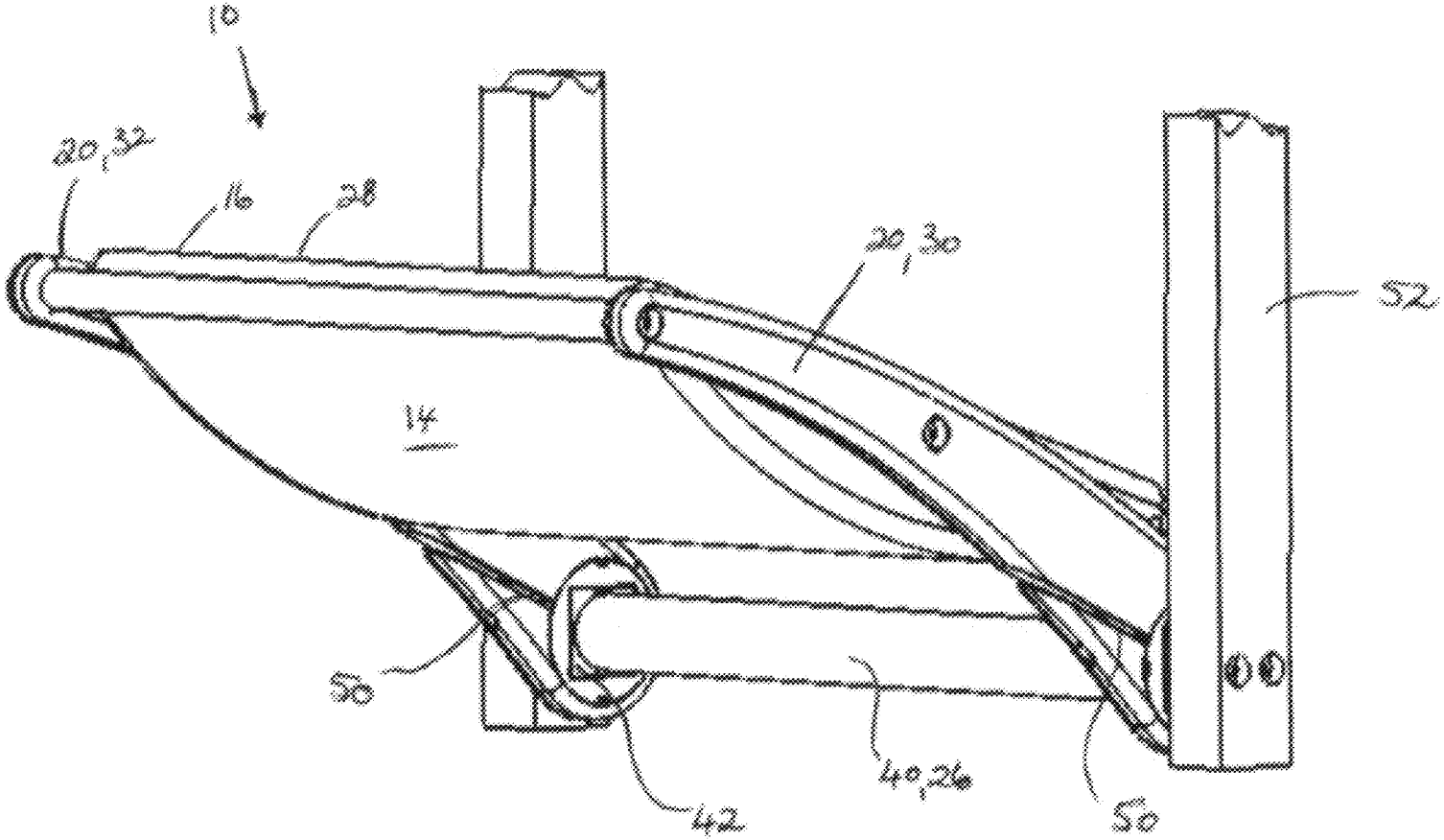
FIG. 6 illustrates an embodiment of the footrest being mounted onto or integrally formed as an accessory to an existing structure.

The footrest (10) can be mounted onto or integrally formed as an accessory to an existing structure or chair by fixing the fulcrum or cross member to one or more static elements (52) of the existing structure as illustrated in FIG. 6.

To allow the footrest to be used as a freestanding device, the footrest (10) can be provided with a base (54) for supporting the footrest (10) on the floor (12). In the embodiments illustrated in FIGS. 1 and 2, the base (54) comprises first and second base members (56) disposed at the distal ends of the cross member (40) and fixedly connected thereto via the hubs (44) arranged at each of the distal ends of the cross member (40). Each of the base members (56), when viewed in side elevation, is crescent-shaped flat member which is oriented vertically when the base is positioned on the floor in use such that each base member comes into contact with the support surface at only two contact points (58) to improve stability. The base members (56) could equally be flush with the floor but this would render the footrest more sensitive to uneven floor surfaces. The first and second base members (56) thus engage with the floor at the contact points at which the force applied to the platform (14) is counteracted, allowing the first and second support arms (30 and 32, respectively) to pivot about the cross member (40) which functions as the fulcrum (26).

The materials of construction of the footrest can vary. By way of example, the base members and support arms can be formed of a suitable material, such as aluminium, titanium, steel, or acrylonitrile-butadiene-styrene (ABS). When aluminum is used it can be anodized to match almost any color and increase the long-term durability of its finish. For sustainability, recycled materials can be used. The platform can be constructed of similar materials or made of wood, such as plantation timber, or recycled plastic.

Exemplary dimensions of the platform of the footrest are 450 millimeters in width (W) and 310 millimeters in depth (D). Exemplary length of each support arm and each of the base members is 410 millimeters in length. Exemplary height of the second end of the support arms relative to the floor is 140 mm. Testing revealed that a load of between 13 and 24 kgs is applied to the platform when the user was sitting in an ergonomic office task chair set at the correct height for that used.

A combination of selective rotation of the platform relative to the support arm and levered movement of the platform relative to the fulcrum provide for height and orientation adjustment of the upper surface of the platform relative to the floor. In this way, the elevation of the platform relative to the floor is dynamically adjustable in use dependant on the degree to which the user of the footrest applies a downward force to the upper surface of the platform.

Now that the preferred embodiments of the present invention have been described in detail, the present invention has a number of advantages over the prior art, including the following:

a) the dynamically coupled spring-loaded platform allows the user the freedom to move and to change posture positions whilst seated.

b) the effects of fatigue caused by sitting in one position for any period of time are reduced without any need to make further adjustments to the footrest after the initial set up of the height of the first position relative to the floor.

c) the user can flex their ankles as well as perform resistance exercises in the confines of their office workstation or airline seat.

d) the footrest can be used under medical supervision as a post-operative device as a means of increasing muscle condition and blood flow to the ankles and feet.

e) the platform is double sided and can to be used with or without shoes.

f) the footrest may assist in the alleviation of Deep Vein Thrombosis (DVT) in airline and coach passengers allowing passengers the option to perform exercises in the confines and safety of their seat, with the additional benefit of reducing the risks associated with moving about the cabin whilst in transit.

g) When the platform is pivotally coupled to the support arms, the footrest provides support for the user's feet while allowing the angle between the user's feet and shins to fluctuate, reducing the likelihood of stiffening of the user's ankles.

h) As a result of the dynamic coupling of the platform to the fulcrum, the footrest provides support for the user's feet while allowing the angle between the user's knees and hips to fluctuate, improving circulation.

Now that several embodiments of the invention have been described in detail, it will be apparent to persons skilled in the relevant art that numerous variations and modifications can be made without departing from the basic inventive concepts. For example, whilst the support arms and the base members are of substantially equal length in the illustrated embodiments, it is equally possible for the support arms to be shorter than the base elements. To improve the robustness of the footrest, a first tie rod element (60) may be provided to connect the second end of each of the base members to each other as best seen in FIG. 4. In an analogous manner, a second tie rod element (62) may be provided to connect the second end of each of the first and second support arms (30 and 32, respectively) to each other as best seen in FIG. 4. The biasing means (42) could take the form of a bearing positioned at each end of the connecting means (40) to serve as a pivot for the fulcrum (26) in combination with a pair of spring elements in the form of a conventional steel spring or a gas strut. All such modifications and variations are considered to be within the scope of the present invention, the nature of which is to be determined from the foregoing description and the appended claims.

All of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed:

1. A footrest for supporting the feet of a user above a floor comprising:

a platform including an upper surface for accommodating the feet of the user and a pair of planar portions extending downwardly from said upper surface;

the platform coupled to a pair of support arms that support a portion of the platform in an elevated position relative to the floor, each of the support arms including a first end dynamically coupled to a fulcrum such that each support arm is biased towards a first position and moveable towards a second position responsive to a force being applied in use to the upper surface of the platform by the feet of the user, and, the platform is rotatably coupled to the support arms so that an angle formed between a leading edge of the platform relative to the floor varies upon application of a titling force on the platform by the feet of the user.

2. The footrest according to claim 1 further comprising a biasing means provided at the fulcrum for biasing the at least one support arm towards the first position, while allowing movement of the support arms towards the second position responsive to a force being applied, in use, to the upper surface of the platform by the feet of the user.

3. The footrest according to claim 1 wherein the biasing means is a torsion element.

4. The footrest according to claim 1 wherein the height of the first position of the platform above the floor is adjustable when the footrest is not in use using an adjustment means provided in at least one support arm, the adjustment means comprising a clamp that, when locked in use, fixes the position of a casing relative to a hub.

5. The footrest according to claim 4 wherein the adjustment means is unlockable to allow an angle of the at least one support arm relative to the floor to be increased or decreased to vary a height of the first position of the platform.

6. The footrest according to claim 1 wherein the support arms include a first support arm and a second support arm and the platform is rotatably mounted via a connecting member extending at right angles between the first and second support arms.

7. The footrest according to claim 6 wherein the connecting member holds a position of the first and second support arms fixed relative to each other.

8. The footrest according to claim 1 wherein the platform has a flat surface and a convex surface and the platform is oriented such that the convex surface is the upper surface.

9. The footrest according to claim 8 wherein the platform is movable from one orientation in which the flat surface is the upper surface to another orientation in which the convex surface is the upper surface by rotation about a connecting member.

10. The footrest according to claim 1 wherein the support arms include a first support arm and a second support arm, and a first end of each of the first and second support arms is dynamically coupled to a cross member, and the cross member is the fulcrum.

11. The footrest according to claim 10 wherein the cross member includes distal ends that terminate in a generally square shaped centrally located hub about which one or more elastomeric bearing elements is disposed.

12. The footrest according to claim 11 wherein the one or more elastomeric bearing elements are housed within a casing to restrict the movement of the elastomeric bearing elements relative to the hub.

13. The footrest according to claim 11 wherein the elastomeric elements allow movement of the casing over the range of plus or minus 30 degrees relative to the hub.

14. The footrest according to claim 1 wherein the footrest is mounted onto or integrally formed as an accessory to an existing structure or chair by fixing the fulcrum to a static element of the existing structure or chair.

15. The footrest according to claim 1 further comprising a base for supporting the footrest on the floor.

16. The footrest according to claim 15 wherein the base comprises first and second base members disposed at the distal ends of a cross member and fixedly connected thereto via hubs arranged at each of the distal ends of the cross member.

17. The footrest according to claim 16 wherein the base members, when viewed in side elevation, are crescent-shaped flat members which are oriented vertically when the base is positioned on the floor in use such that each base member comes into contact with the support surface at only two contact points.

* * * * *